US008007597B2

(12) United States Patent
Beaudet et al.

(10) Patent No.: US 8,007,597 B2
(45) Date of Patent: Aug. 30, 2011

(54) DISHWASHER PROVIDING USAGE GUIDANCE

(75) Inventors: Douglas B. Beaudet, Mattawan, MI (US); Christopher G. Koch, Saint Joseph, MI (US); Sandra C. Steward, Benton Harbor, MI (US); Daniel Szecket, Pittsburgh, PA (US); Jonathan West, Pittsburgh, PA (US)

(73) Assignee: Whirlpool Corporation, Benton Harbor, MI (US)

( * ) Notice: Subject to any disclaimer, the term of this patent is extended or adjusted under 35 U.S.C. 154(b) by 227 days.

(21) Appl. No.: 12/330,951

(22) Filed: Dec. 9, 2008

(65) Prior Publication Data

US 2010/0139721 A1 Jun. 10, 2010

(51) Int. Cl.
*B08B 3/02* (2006.01)

(52) U.S. Cl. ..... 134/18; 134/25.2; 134/57 D; 134/58 D

(58) Field of Classification Search ..... 134/56 D, 134/58 D, 113; 68/12.02
See application file for complete search history.

(56) References Cited

U.S. PATENT DOCUMENTS

| | | | | |
|---|---|---|---|---|
| 5,715,555 | A * | 2/1998 | Reber et al. | 8/158 |
| 6,463,940 | B1 * | 10/2002 | Thomas et al. | 134/56 R |
| 6,626,013 | B2 * | 9/2003 | Ohta et al. | 68/12.27 |
| 6,626,439 | B1 * | 9/2003 | Forry et al. | 277/592 |
| 6,666,220 | B2 * | 12/2003 | Spanyer et al. | 134/58 D |
| 7,337,634 | B2 * | 3/2008 | Buckroyd et al. | 68/12.23 |
| 7,404,225 | B2 * | 7/2008 | Jo et al. | 8/158 |
| 7,658,806 | B2 * | 2/2010 | Jeong et al. | 134/56 D |
| 2004/0156170 | A1 * | 8/2004 | Mager et al. | 361/683 |
| 2009/0153494 | A1 * | 6/2009 | Laundroche et al. | 345/173 |

FOREIGN PATENT DOCUMENTS

| | | | |
|---|---|---|---|
| CN | 1442537 | * | 9/2003 |
| DE | 31 33 176 | * | 10/1982 |
| DE | 63-281695100 35 181 | * | 12/2001 |
| JP | 05-345090 | * | 12/1993 |
| JP | 09-084989 | * | 3/1997 |
| JP | 11-197084 | * | 7/1997 |
| JP | 2002-137794 | * | 5/2002 |
| JP | 2004-275267 | * | 10/2004 |
| KR | 2002080795 | * | 10/2002 |

OTHER PUBLICATIONS

European Patent Office 1 925 250 May 2008.*
WIPO WO 2008/0777529 Jul. 2008.*

* cited by examiner

*Primary Examiner* — Frankie L Stinson
(74) *Attorney, Agent, or Firm* — Robert A. Bacon

(57) ABSTRACT

A dishwasher includes a tub having a door that provides access to the tub. The door has a handle which extends a top surface of the door beyond a front surface of the door. A touchscreen panel is mounted to the top surface of a door to provide a user interface. The user interface includes a carrousel of icons via which a user may select a wash cycle. The user interface further includes a programmed delay interface via which a user may specify a desired start time and/or stop time for the wash cycle. The user interface may further provide the user with usage guidance to aid the user in the usage of the dishwasher.

15 Claims, 7 Drawing Sheets

DISHWASHER PROVIDING USAGE GUIDANCE

TECHNICAL FIELD

The present disclosure relates generally to a dishwasher and more particularly to interface controls for a dishwasher.

BACKGROUND

A dishwasher is a domestic appliance into which dishes and other cooking and eating wares (e.g., plates, bowls, glasses, flatware, pots, pans, bowls, etc.) are placed to be washed. A dishwasher includes a number of dishwasher racks which support such wares. Dishwashers generally include a control panel of a push buttons, switches and/or dials via which a user may select operating parameters (e.g. wash cycles, water temperature, drying modes, etc.) to control operation of the dishwasher.

SUMMARY

According to one aspect, a dishwasher to be installed under a countertop includes a tub defining a washing chamber, and at least one dishwasher rack positioned in the washing chamber of the tub. The dishwasher further includes a door to permit access to the washing chamber. The door includes a handle that defines a top surface of the door and that extends the top surface of the door beyond a front surface of the door. A touchscreen panel is positioned upon the top surface of the door such that a user interface presented by the touchscreen panel is viewable and accessible from the top surface of the door.

According to another aspect, a dishwasher includes a tub defining a washing chamber, and a dishwasher rack positioned in the washing chamber of the tub. The dishwasher further includes a door to permit access to the washing chamber and includes a handle that extends a top surface of the door beyond a front surface of the door. A touchscreen panel is positioned upon the top surface of the door and includes an input layer to generate one or more signals indicative a touched location of the touchscreen panel and a display layer to generate a user interface based upon one or more signals representative of the user interface. A controller receives the one or more signals indicative of the touched location, generates the one or more signals representative of the user interface, and controls operation of the dishwasher based upon the one or more signals indicative of the touched location.

In some embodiments, the touchscreen panel may be positioned upon the top surface of the door such that a display surface of the touchscreen panel is substantially planar with the top surface of the door. In particular, the touchscreen panel may be positioned upon the top surface of the door such that a display surface of the touchscreen panel is substantially parallel with the top surface of the door, a front portion of the display surface is positioned toward the front surface of the door, a back portion of the display surface is positioned toward a back surface of the door, and the back portion of the display surface is obscured by the countertop and the front portion of the display surface extends beyond the countertop when the door is closed. Furthermore, when the door is closed, a front portion of the touchscreen panel may display status information and may display one or more user interface controls to permit entry of user selections via the one or more user interface controls The handle in some embodiments may extend the top surface of the door substantially perpendicular to the front surface of the door, and the touchscreen panel may be positioned upon the top surface of the door such that when the door is closed a front portion of the touchscreen panel extends beyond the countertop and a back portion of the touchscreen panel is blocked by the countertop.

In some embodiments, the handle extends the top surface of the door in angle away from the countertop when the door is closed.

In other embodiments, the touchscreen panel may be positioned upon the top surface of the door such that a front edge of the touchscreen panel is positioned toward the front surface of the door and a back edge of the touchscreen panel is positioned toward a back surface of the door, the front edge and the back edge of the touchscreen panel define a height of the touchscreen panel, the front surface and back surface of the door define a thickness of the door, and the height of the touchscreen panel is greater than the thickness of the door. Further, a controller may be positioned between the front surface and back surface of the door, and a handle assembly comprising the handle and the touchscreen panel, the handle assembly being detachably coupled to the door and the control panel.

The top surface of the door of the door may be non-planar and a display surface of the touchscreen panel may follow contours of the non-planar top surface of the door.

According to another aspect, a dishwasher comprises a tub defining a washing chamber and a dishwasher rack positioned in the washing chamber of the tub. The dishwasher includes a door to permit access to the washing chamber. A control panel permits selecting a desired stop time for a wash cycle. A controller determines a start time for the wash cycle based the desired stop time selected via the control panel.

The control panel may permit a time of day to be specified for the desired stop time for the wash cycle, and the controller may determine the start time for the wash cycle based upon the desired stop time and a duration of the wash cycle.

The controller may determine a duration of the wash cycle, cause the control panel to display a bar having a length representative of the duration of the wash cycle, a first end associated with a start time, and a second end associated with the desired stop time, and permit moving the bar in relation to a time scale to simultaneously adjust the start time and the desired stop time of the wash cycle.

The controller may further cause the control panel to display the duration in units of time, the start time as a time of day, and the desired stop time as a time of day.

The control panel may permit selecting the wash cycle from a plurality of wash cycles having different durations, and the controller may determines the start time for the wash cycle based upon the desired stop time and the duration of the wash cycle selected from the plurality of wash cycles.

The control panel may permit selecting the wash cycle from a plurality of wash cycles having different durations, and selecting options that effect the durations of the plurality of wash cycles. The controller may determine an expected duration for the selected wash cycle with the selected options, and may determine the start time for the wash cycle based upon the desired stop time and the expected duration for the selected wash cycle with the selected options. The controller may further determine the expected duration based upon a maximum duration for the selected wash cycle and upon maximum effects for the selected options.

In some embodiments, the controller may determine the expected duration based upon a typical duration for the selected wash cycle and upon typical effects for the selected options. The controller may cause the control panel to present alternative wash cycles and/or options if the controller determines there is insufficient time to complete the wash cycle by the desired stop time. The controller may cause the control panel to provide a warning that an expected stop time for the selected wash cycle with the selected options extends beyond the desired stop time.

In yet another aspect, a dishwasher includes a tub defining a washing chamber, and a dishwasher rack positioned in the washing chamber of the tub. The dishwasher includes a door to permit access to the washing chamber, and a touchscreen panel receives user input and displays usage guidance. A controller is coupled to the touchscreen panel to select the usage guidance based upon the user input and to cause the touchscreen panel to display the usage guidance selected based upon the user input.

The usage guidance selected based upon the user input may include loading tips that provide guidance regarding loading of the dishwasher, and/or performance tips that suggest actions to be undertaken by a user to increase efficiency of the dishwasher. The usage guidance selected based upon the user input may include wash cycle descriptions that provide information regarding intended use of a selected wash cycle, and/or option descriptions that provide information regarding an effect a selected option has on a wash cycle. The usage guidance selected based upon the user input may also include directions for performing maintenance on the dishwasher. 19. The usage guidance selected based upon the user input may also include presenting information regarding historical usage of energy and/or water by the dishwasher.

The controller may select usage guidance based upon operating status of the dishwasher and may cause the touchscreen panel to display the usage guidance selected based upon the operating status. The usage guidance based upon operating status of the dishwasher may include instructing a user that a dish may be added even though the wash cycle is running if sufficient time remains in the wash cycle, and/or directing a user to add rinse aid in response to detecting that the rinse aid is low.

Accordingly to another aspect, a dishwasher includes a tub defining a washing chamber, and a dishwasher rack positioned in the washing chamber of the tub. The dishwasher includes a door to permit access to the washing chamber, and a touchscreen panel on the door. The touchscreen includes an input layer to generate one or more input signals indicative of touched locations of the touchscreen panel and a display layer to display a user interface based upon one or more display signals. A controller is coupled to the touchscreen panel. The controller generates one or more display signals representative of a carrousel of the user interface, receives one or more input signals indicative of touched locations of the touchscreen panel, identifies a selected wash cycle based upon a touched location in relation to icons of the carrousel, and controls operation of the dishwasher per the selected wash cycle.

In some embodiments, the controller may generate one or more display signals that result in the display layer animating rotation of the carrousel about an axis in response to touched locations of the touchscreen panel.

The controller may generate one or more display signals that result in the display layer animating rotation of the carrousel about an axis in a direction dependent upon a touched location of the touchscreen panel. In response to determining that the touchscreen panel was touched toward a right side of the carrousel, the controller may generate one or more display signals that result in the display layer animating rotation of the carrousel in a clockwise direction. In response to determining that the touchscreen panel was touched toward a left side of the carrousel, the controller may generate one or more display signals that result in the display layer animating rotation of the carrousel in a counter-clockwise direction.

The controller may generates one or more display signals that result in the display layer displaying the carrousel such that one icon of the plurality of icons is positioned toward a front and center position of the carrousel, and may determine that a wash cycle associated with the one icon positioned toward the front and center position is the selected wash cycle in response to determining that the touched location is proximate to the front and center position of the carrousel.

The controller may generate one or more display signals that result in the display layer displaying available options for the selected wash cycle, and may determine which of the available options have been selected based upon touched locations represented by one or more input signals of the input layer. The controller may further generate one or more display signals that depict default selections for the available options.

The controller may generate one or more display signals that enables selection of a high temperature wash option only if a high temperature wash is one of the available options for the selected wash cycle.

The controller may generate one or more display signals that enables selection of a sanitizing option only if sanitizing is one of the available options for the selected wash cycle.

The controller may generate one or more display signals that enables selection of a zonal spray option that directs cleaning to a pre-designated zone of the washing chamber only if a zonal spray is one of the available options for the selected wash cycle.

BRIEF DESCRIPTION OF THE DRAWINGS

The detailed description particularly refers to the following figures.

DETAILED DESCRIPTION OF THE DRAWINGS

Figure 1:
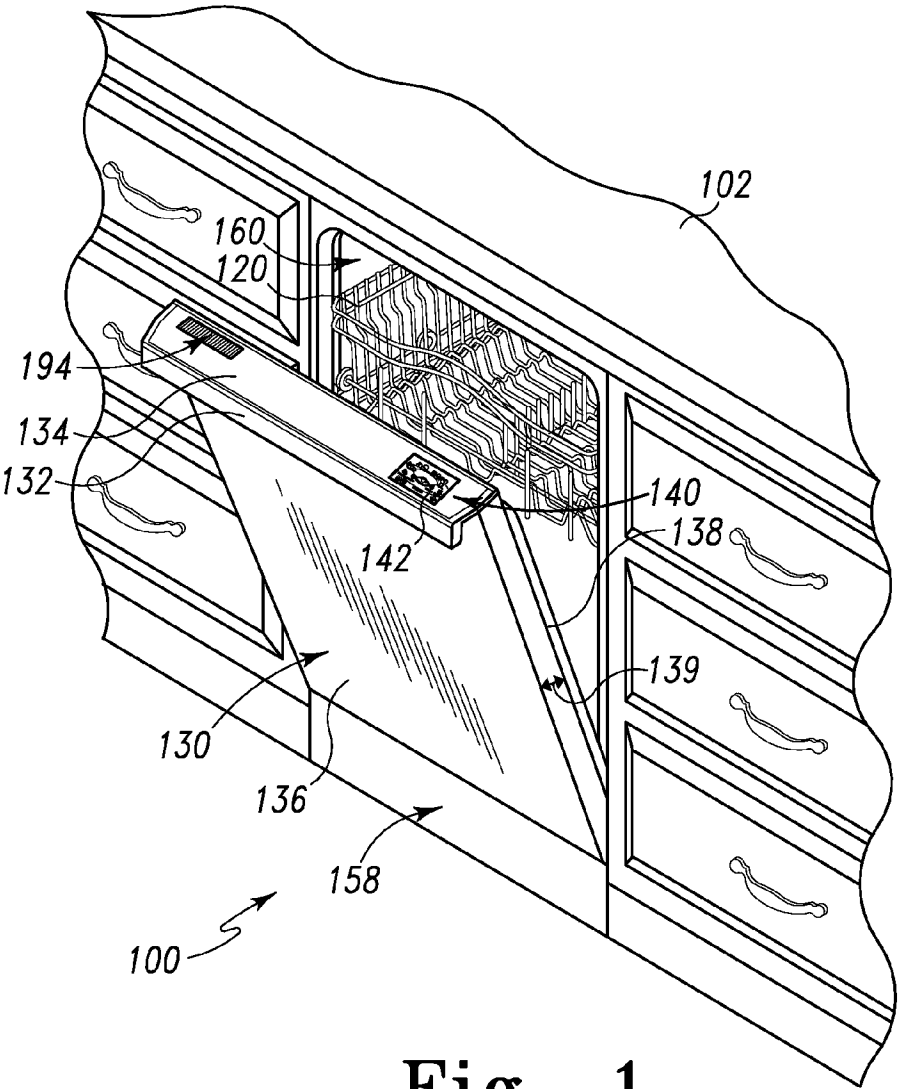
FIG. 1 shows one embodiment of a dishwasher installed under a countertop with the door partially opened.

While the concepts of the present disclosure are susceptible to various modifications and alternative forms, specific exemplary embodiments thereof have been shown by way of example in the drawings and will herein be described in detail. It should be understood, however, that there is no intent to limit the concepts of the present disclosure to the particular forms disclosed, but on the contrary, the intention is to cover all modifications, equivalents, and alternatives falling within the spirit and scope of the invention as defined by the appended claims.

Figure 2:
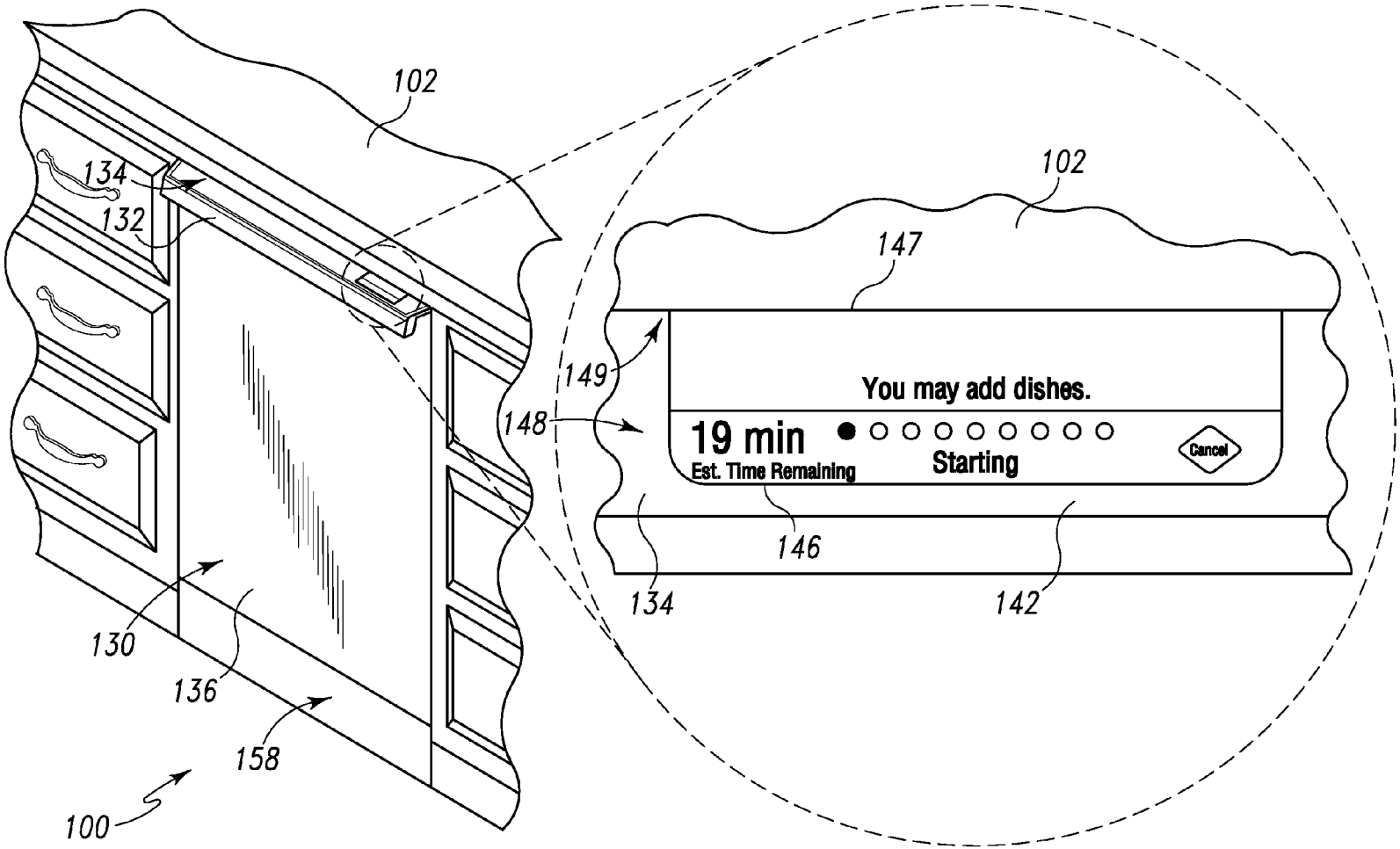
FIG. 2 shows the dishwasher of FIG. 1 installed under a countertop with the door closed.
Figure 3:
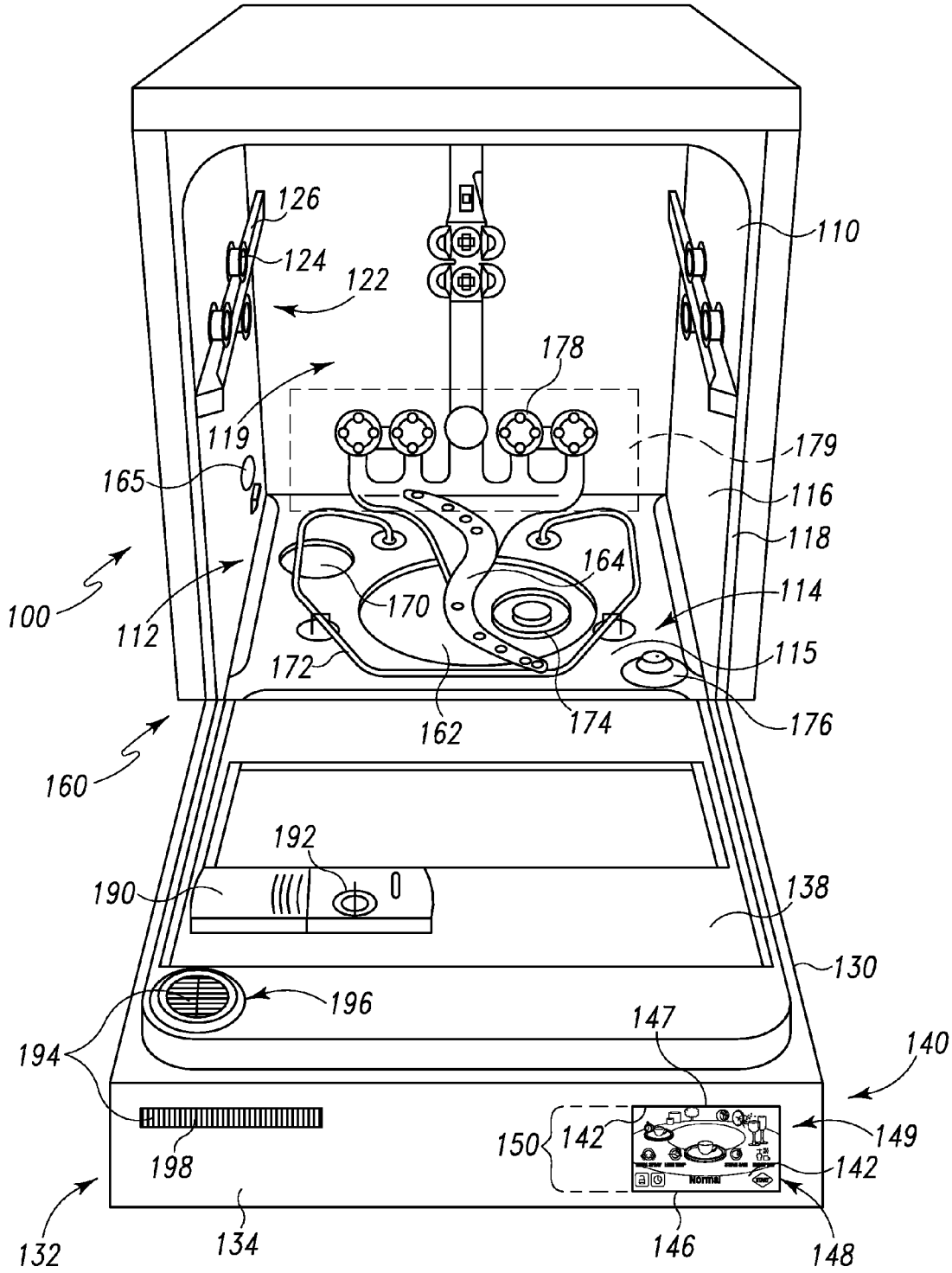
FIG. 3 shows the dishwasher of FIG. 1 with the door fully opened and dishwasher racks removed.
Figure 4:
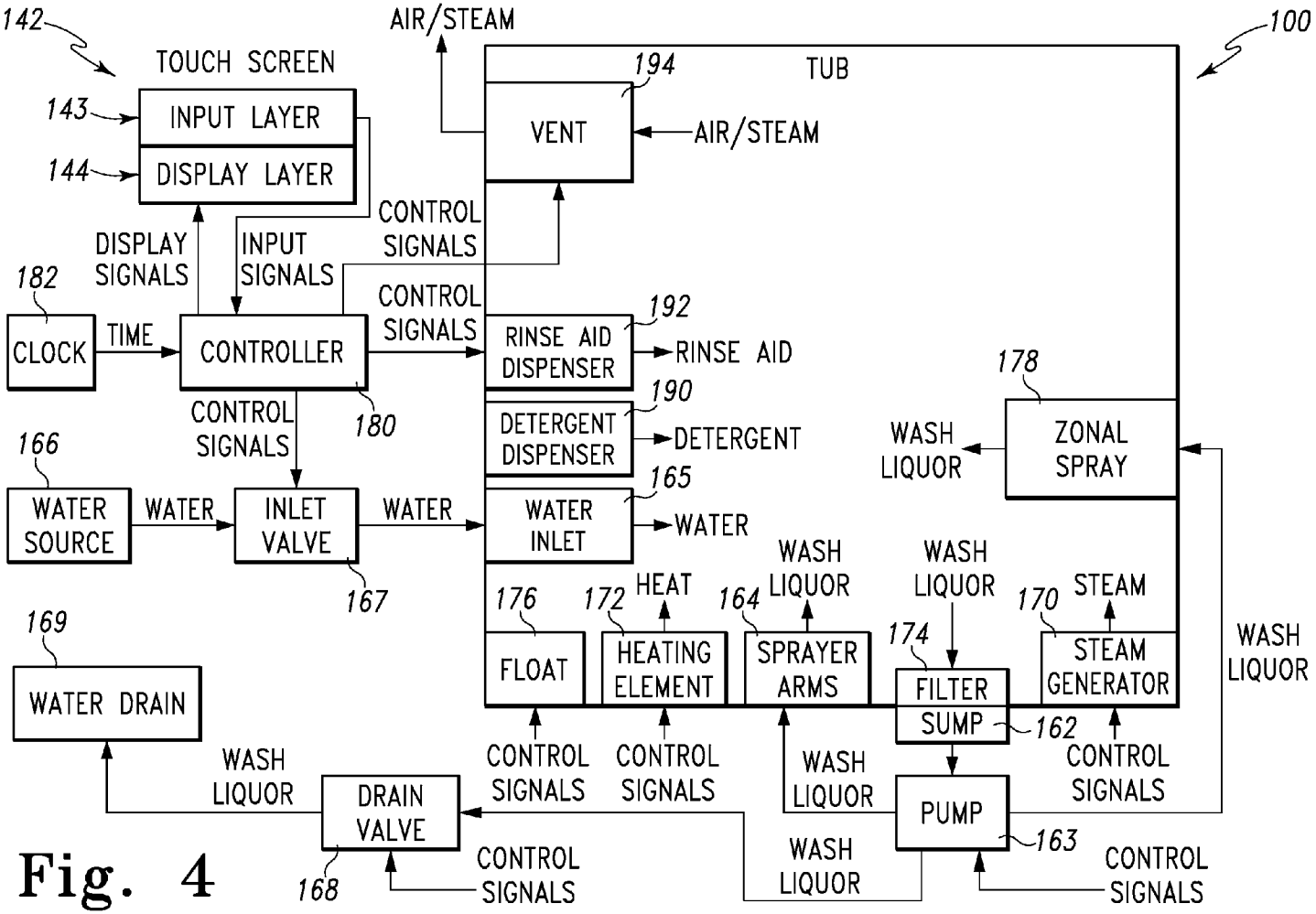
FIG. 4 shows a block diagram depicting interconnections between various components of the dishwasher of FIG. 1.

Referring now to FIGS. 1, 2, 3 and 4, an embodiment of a dishwasher 100 that may be installed under a countertop 102 is shown. In particular, FIG. 1 shows a door 130 of the dishwasher 100 in a partially open position and FIG. 2 shows the door 130 of the dishwasher 100 in a closed position. FIGS. 3 and 4 show aspects of the dishwasher 100 in greater detail.

As shown, the dishwasher 100 includes a tub 110 that defines a washing chamber 112 into which dishes and other cooking and eating wares (e.g., plates, bowls, glasses, flatware, pots, pans, bowls, etcetera) are placed to be washed. The dishwasher 100 also includes a number of racks 120 located in the tub 110. In particular, the dishwasher 100 may include upper and lower dishwasher racks 120, though only the upper dishwasher rack is shown in FIG. 1. A number of roller assemblies 122 are positioned between the dishwasher rack 120 and the tub 110. The roller assemblies 122 allow the dishwasher racks 120 to extend from, and retract back into, the tub 110. Such movement facilitates the loading and unloading of the dishwasher racks 120. The roller assemblies 122 include a number of rollers 124 which roll along the top of, and in some cases the top and bottom of, a corresponding support rail 126.

The door 130 is hinged to the lower front edge of the tub 110. The door 130 permits access to the tub 110 in order to load and unload the dishwasher 100. The door 130 also seals the front of the dishwasher 100 during a wash cycle. The door 130 includes a handle 132, a top surface 134, a front surface 136, a back surface 138, and a thickness 139 defined by the distance between the front surface 136 and the back surface 138. The handle 132 is operable by a user to unlatch the door 130 so that the door 130 may be opened by the user. Further, the handle 132 in one embodiment extends the top surface 134 of the door 130 beyond the front surface 136 of the door 130 to accommodate a control panel 140 on the top surface 134 of the door.

The embodiment shown in FIGS. 1-4 includes a hinged door 130. However, other embodiments of the dishwasher 100 may utilize a slide-door or some other type of door. For example, in an embodiment with a slide door, the door 130 slideably engages the tub 110 such that the door 130 slides into and out of the tub 110 in a manner similar to a drawer of a chest of drawers.

The control panel 140 may include a number of controls such as buttons and knobs, that are used to control operation of the dishwasher 100. As explained in more detail below, the control panel 140 in one embodiment comprises a touchscreen panel 142 positioned upon the top surface 136 of the door 130. Furthermore, the touchscreen panel 142 in one embodiment comprises the sole control of the control panel 140, thus permitting a user to control all user accessible operations of the dishwasher 100 via the touchscreen panel 142. However, in other embodiments, the control panel 140 may include a touchscreen panel 142 along with one or more buttons and knobs that may be actuated to control operation of the dishwasher 100. In yet another embodiment, the control panel 140 may include a display panel such as a liquid crystal display (LCD) panel or some other type of display panel along with one or more buttons associated with the display panel which may be actuate to control operation of the dishwasher 100.

A machine compartment 158 is located below the tub 110. The machine compartment 158 is sealed from the tub 110. In other words, unlike the tub 110, the machine compartment 158 does not fill with water during operation of the dishwasher 110. The machine compartment 158 houses components such as the dishwasher's water pump(s) and valve(s), along with the associated wiring and plumbing.

Referring now to FIGS. 3 and 4, aspects of the dishwasher 100 are shown in greater detail. As shown, the tub 110 includes a bottom wall 114 having a number of side walls 116 extending upwardly therefrom to define the washing chamber 112. The open front side 118 of the tub 110 defines an access opening 160 of the dishwasher 10. User access to the dishwasher racks 120 positioned in the washing chamber 112 is provided through the access opening 160. As such, when the door 130 is closed, user access to the dishwasher racks 120 is prevented, whereas user access to the dishwasher racks 120 is permitted when the door 130 is open. The door 130 also functions to seal the dishwasher 100 so that water does not escape the access opening 160 of the dishwasher 10 during a wash cycle.

The bottom wall 114 of the tub 110 has a recirculation sump 162 formed therein. The recirculation sump 162 is formed (e.g., stamped) into the bottom wall 114 of the tub 110. In particular, as shown in FIG. 2, the recirculation sump 162 defines a reservoir which extends downwardly in a direction away from the upper surface 115 of the bottom wall 114. The sloped configuration of the bottom wall 114 of the tub 110 directs the wash liquor (e.g., water and detergent) into the recirculation sump 162 during a wash cycle. Such wash liquor is drained from the recirculation sump 162 and re-circulated onto the dishwasher racks 120 by a pump 163 located in the mechanical compartment 158. The output from the pump 160 is connected to a rotating spray arm 164 which sprays the re-circulated wash liquor onto the dishwasher racks 120 (and hence the wares being washed).

A sidewall 116 of the tub 110 further includes a water inlet opening 165. The water inlet opening 165 directs water received from an external water source 166 (e.g. house water main, kitchen faucet, etc.) into the washing chamber 112. In one embodiment, a controller 180 generates control signals to selectively open and close an inlet valve 167 and a drain valve 168 to control the water level in the washing chamber 112 during operation of the dishwasher 110. In particular, the controller 180 may generate control signals to selectively open and close the inlet valve 167 to control the flow of water from the external water source 166 into the washing chamber 112, and may generate control signals to selectively open and close the drain valve 168 to control the flow of water from the pump 163 to an external water drain 169 (e.g. house sewer line, kitchen sink, etc.). Water introduced into the washing chamber 112 via the water inlet opening 165 accumulates in the recirculation sump 162 which is then re-circulated onto the dishwasher racks 120 by the pump 163.

The dishwasher 100 also includes a steam generator 170 positioned upon the bottom wall 114 of the tub 110. The steam generator 170 accumulates water or wash liquor and heats the accumulated water or wash liquor to produce steam within the washing chamber 112. The generated steam may aid in removing certain tough soils from the wares in the dishwasher racks 120.

A heating element 172, a filter 174, and an overfill protection float 176 are also positioned on or near the bottom wall 114 of the tub 110. The heating element 172 may heat the wash liquor which accumulates on the bottom wall of the tub 110 which may aid in removing soils from the wares in the dishwasher racks 120 during wash and/or rinse cycles. The heating element 172 may also be used to heat air in the washing chamber 112 during a drying stage of a wash cycle.

The filter 174 filters particulates from the wash liquor during the wash and/or rinse stages of wash cycle. The overfill protection float 176 provides a sensing mechanism which a controller 180 of the dishwasher may use to control the water level of the washing chamber 112.

Along the lower back side 119 of the tub 110, the dishwasher 110 further includes several rotating high pressure sprayers 178. The rotating high pressure sprayers 178 focus the wash liquor at a high pressure toward a pre-designated zone 179 of the washing chamber 112 along the lower back of the washing chamber 112 thus creating a zone 179 of increased cleaning capabilities. In one embodiment, the controller 180 in response to a zonal spray option being selected causes the pump 163 to re-circulate the wash liquor solely through the high pressure spray jets 178 during certain periods of the selected wash cycle. As a result, the cleaning power of the dishwasher 100 is focused upon cleaning surfaces of wares located in or near the pre-designated zone 179 of the washing chamber 112.

The controller 180 is generally coupled to components of the dishwasher 100 to control the operation of such components and to monitor the operations of such components. In particular, the controller 180 may comprise analog and/or digital circuitry positioned between the front surface 136 and back surface 138 of the door 130 that cooperate to process signal received from the components of the dishwasher 100 and provide control signals to components of the dishwasher 100. In one embodiment, the controller 180 comprises a microcontroller that executes firmware routines that cause the controller 180 to control the operation of the dishwasher 100.

The dishwasher 100 further includes a clock 182 that provides a time of day. The clock 182 may be a standalone timepiece that maintains the time of day and provides an indication of the time of day to the controller 180. In other embodiments, the clock 182 may be implemented using a periodic source such as a quartz crystal, an AC power source, etc. and software executed by the controller 180 which essentially counts cycles of the periodic source to arrive at a time of day.

The dishwasher 100 further includes a detergent dispenser 190 and rinse aid dispenser 192 located on a back surface 138 of the door 130. Detergent may be placed in the detergent dispenser 190 and rinse aid may be placed in the rinse aid dispenser 192. The controller 180 may generate control signals that cause the detergent dispenser 190 to release detergent into the washing chamber 112. The released detergent then mixes with water in the washing chamber 112 to form the wash liquor used to remove soil from wares during wash cycles. Similarly, the controller 180 may generate control signals that cause the rinse aid dispenser 192 to release rinse aid into the washing chamber 112. The released rinse aid then mixes with water in the washing chamber 112 to form a wash liquor which may aid in the rinsing during a rinse stage and subsequent drying of the wares during a drying stage of a wash cycle.

Furthermore, the dishwasher 100 includes vents 194 in the door 130. As shown, the vents 194 may include openings 196 in an upper portion of the back surface 138 of the door 130 and openings 198 in a top surface 134 of the door 130. The controller 180 may generate control signals to selectively open the vents 194 to permit air and/or steam to escape the washing chamber 112 via the vents 194 and to selectively close the vents 194 to prevent air and/or steam from escaping the washing chamber 112 via the vents 194.

As shown in FIG. 5, the touchscreen panel 142 includes an input layer 143 and a display layer 144. The display layer 144 generally displays or presents graphical images based upon display signals received from the controller 180. In particular, the display layer 144 may dynamically present both static and moving images constructed from display signals that represent the images. To this end, the display layer 144 in one embodiment may comprise a liquid crystal display (LCD) panel, but graphical display panels using other technologies may also be used such as electronic paper, organic light-emitting diode technology (OLED) display panels, plasma display panels, surface-conduction electron-emitter display (SED) panels, and vacuum fluorescent display (VFD) panels.

The input layer 143 generally senses a single point of contact or touch of display surface 145 by a finger, hand or other passive device such as a stylus. In response to the sensed touch, the input layer 143 generates one or more input signals from which the controller 180 may determine the location or point of contact of the touch upon the display surface 145. In other embodiments, the input layer 143 may sense multiple points of contact of display surface 145 such as, for example, sensing that the display surface 145 has been touched with two fingers. In response to the sensed multi-touch, the input layer 143 generates one or more input signals from which the controller 180 may determine the multiple locations or points of contact upon the display surface 145. The input layer 143 in one embodiment comprises a resistive input layer, however input layers using other technologies may also be used such as, for example, surface acoustic wave (SAW) input layers, capacitive input layers, strain gauge input layers, optical imaging input layers, dispersive signal input layers, and acoustic pulse input layers.

Besides determining the location at which the display surface 145 was touched, the controller 180 may further correlate the touched location with images displayed by the display layer 144 to determine that a particular image such as a graphical icon or a graphical representation of a user interface control (e.g. button, check box, radio button, scrollbar, arrow, etc.) has been touched. While in a strict sense only the display surface 145 has been "touched" and not the graphical representations displayed by the display layer 144, people generally refer to the act of touching the display surface 145 proximate a displayed icon or graphical control as touching the displayed icon or graphical control. For ease of discussion, the present disclosure and appended claims also generally refer to such acts of touching the display surface 145 as touching the proximate images displayed by the display layer 144.

Referring back to FIGS. 1 and 2, the touchscreen panel 142 in one embodiment is positioned upon the top surface 134 of the door 130. In particular, the touchscreen panel 142 is positioned such that a front edge 146 is positioned toward the front surface 136 of the door 130 and a back edge 147 of the display surface 145 is positioned toward a back surface 138 of the door 130. As a result of such positioning of the touchscreen panel 142 upon the top surface 134 of the door 134, both a front portion 148 and a back portion 149 of the touchscreen panel 142 are viewable and accessible from the from the top surface 142 of the door 130 when the door 130 is partially open as shown in FIG. 1. However, when the door 130 is closed as shown in FIG. 2, the countertop 102 obscures or blocks the view of the back portion 149 of the touchscreen panel 142 but the front portion 148 of the touchscreen panel 142 is still viewable and accessible from the top surface 134 of the door 130. Accordingly, the touchscreen panel 142 may still present status or other information to a user of the dishwasher 100 via the front portion 148 when the door 130 is fully closed. Further, the touchscreen panel 142 may still present user interface controls upon the front portion 148 to permit entry of user selections via the displayed user interface controls even while the door 130 is closed.

Some examples of status information that may be presented via the front portion 148 of the touchscreen panel 142 when the door 130 is closed are:

Filling
Washing
Rinsing
Second Rinse
Drying
Complete
Sanitized
Not Sanitized
Delay time remaining
Cycle time remaining
Relative cycle progression
Control Locked
Cancel Button
OK to Add Dishes
OK to Remove Dishes In order to accommodate a touchscreen panel 142 having a distance or height 150 between the front edge 146 and back edge 147 of the touchscreen panel 142 that is greater than the thickness 139 of the door 130, the handle 132 may extend the top surface 134 beyond the front surface 136 of the door 130 so that the top surface 134 of the door 134 is not confined by the thickness 139 of the door 130. In particular, the handle 132 may extend outwardly from the door 130 such that the top surface 134 is substantially perpendicular to the front surface 136 of the door 130 which results in the top surface 134 being substantially parallel to the countertop 102 when the door 130 is closed.

Figure 5C:
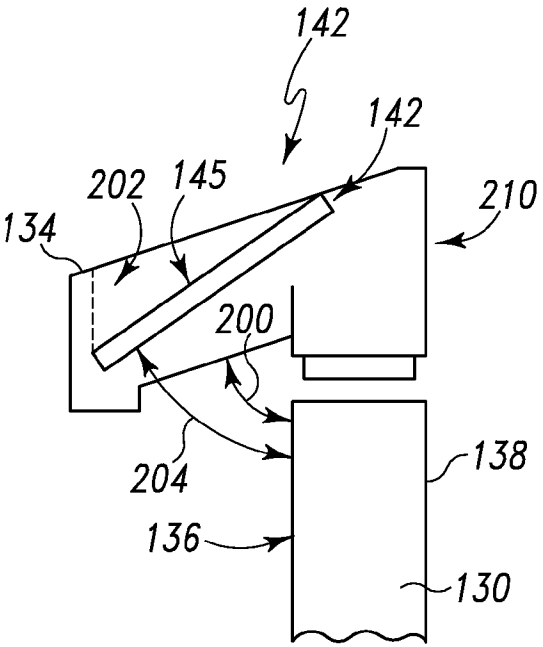
FIG. 5C shows an embodiment of a dishwasher having a detachably handle assembly.
Figure 5B:
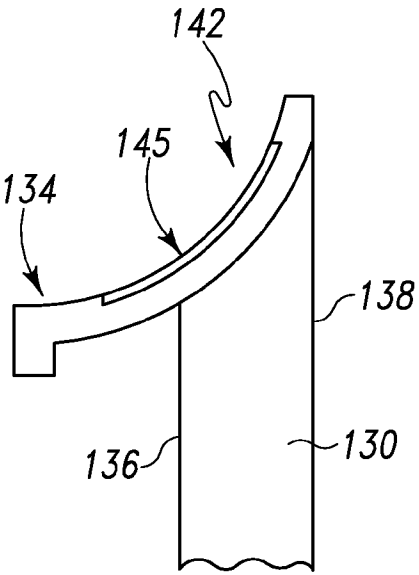
FIG. 5B shows an embodiment of a dishwasher having a door with a contoured top surface.
Figure 5A:
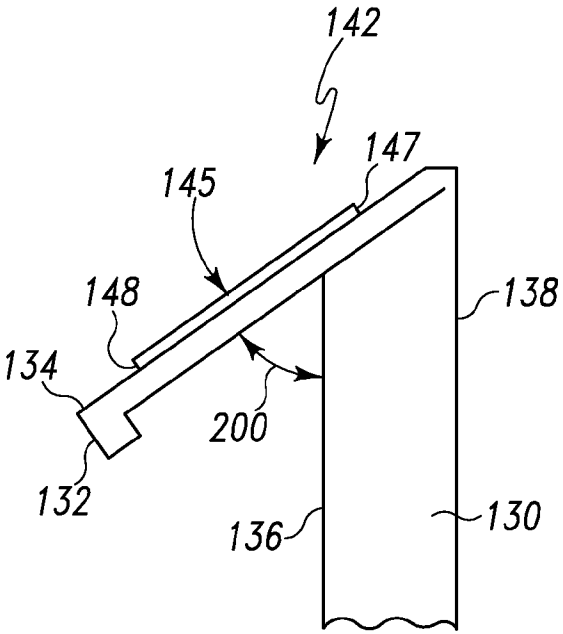
FIG. 5A shows an embodiment of a dishwasher with the handle angled away from the countertop.

In another embodiment, as shown in FIG. 5A, the handle 132 may extend the top surface 134 of the door away from the countertop 102 when the door 130 is closed. In particular, the handle 132 may extend in a downward direction thus forming an acute angle 200 with respect to the front surface 136 of the door.

As shown in FIGS. 1 and 2, the handle 132 and door 130 may define a substantially planar top surface 134 and the touchscreen panel 142 may be positioned such that the display surface 145 is substantially planar with the top surface 134. In another embodiment, as shown in FIG. 5A, the handle 132 and door 130 may still define a substantially planar top surface 134; however, the touchscreen panel 142 may be positioned such that the display surface 145 is raised with respect to the top surface 134.

In the embodiment shown in FIG. 5B, the top surface 134 of the door is non-planar and the display surface 145 of the touchscreen panel 142 follows the contours of the non-planar top surface 134. In the embodiment shown in FIG. 5C, the handle 132 extends from the door 130 in a downward direction forming an acute angle 200 with the front surface 136 of the door 130. Moreover, the handle 132 creates a substantially planar top surface 134 for the door 130. The touchscreen panel 142, however, is positioned in a recess 202 at a more acute angle 204 with respect to the front surface 136 of the door 130 than the angle 200 thus resulting in the display surface 145 not being substantially co-planar with the top surface 134.

FIG. 5C further shows that the handle 132 and touchscreen panel 142 may comprise a handle assembly 210. The handle assembly 210 may be detachably coupled to the door 130 and the controller 180. To this end, the handle assembly 210 may comprise mating connectors or other fastening mechanisms for mechanically connecting the handle assembly 210 to the door 130 and for electrically coupling the touchscreen panel 142 to the controller 180.

Figure 6:
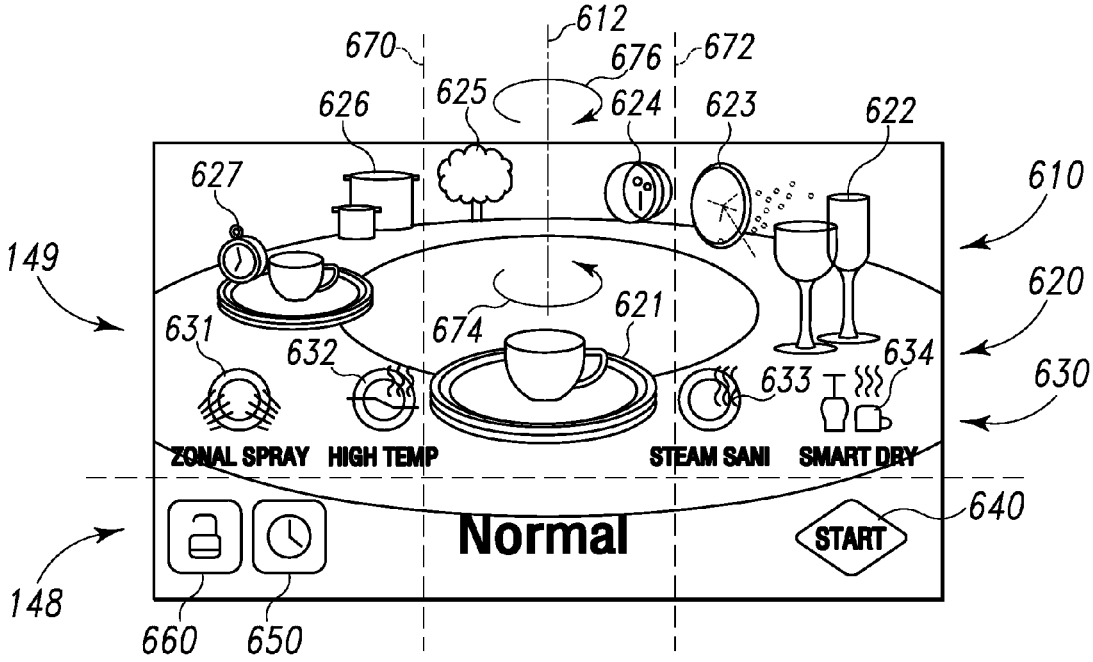
FIG. 6 shows an embodiment of a dishwasher control panel having user interface with a carrousel of icons representative of wash cycles.
Figure 7:
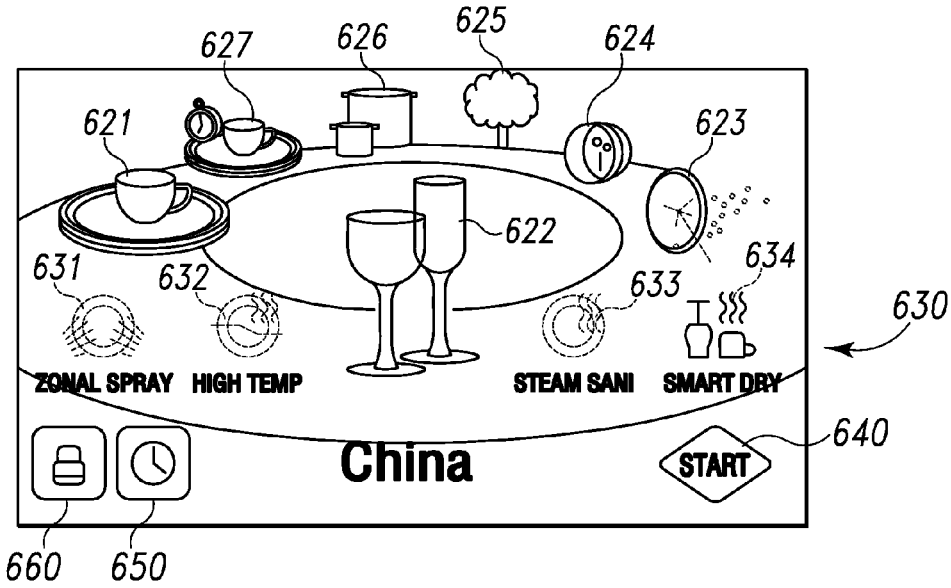
FIG. 7 shows the dishwasher control panel in which the icons of the carrousel of FIG. 6 have been rotated about an axis in response to user input.

Referring now to FIGS. 6 and 7, details regarding an embodiment of a graphical user interface 600 for the control panel 140 are shown. In particular, the controller 180 generates display signals which result in the touchscreen panel 142 displaying the graphical user interface 600 and the touchscreen panel 142 generates input signals which cause the controller 180 to take action based upon touched controls of the graphical user interface 600. As shown, the graphical user interface 600 includes a carrousel 610 having icons 620 positioned about an axis 612 of rotation for the carrousel 610. In one embodiment, each of the carrousel icons 620 is associated with a wash cycle of the dishwasher 100; however other embodiments of the user interface 600 may include carrousel icons associated with other functions of the dishwasher 100 such as for example dishwasher setup functions such as setting a clock and/or available options for the wash cycles. The graphical user interface 600 may further include icons 630 which represent available options for the wash cycles, a start button 640, a programmed delay button 650, and a control lock button 660.

As shown, the carrousel 610 may include a Normal Wash icon 621 associated with a normal wash cycle, a China Wash icon 622 associated with a china wash cycle, a Rinse icon 623 associated with a rinse wash cycle, a Smart Wash icon 624 associated with a smart wash cycle, an Eco Wash icon 625 associated with a eco wash cycle, a Pots and Pans Wash icon 626 associated with a pots and pans wash cycle, and a 1-Hour Wash icon 627 associated with a 1-hour wash cycle. A brief description of each of the wash cycles follows.

During the normal wash cycle, the dishwasher 100 senses soil level and makes adjustments in the water and energy used during the cycle. During the china cycle, the dishwasher 100 provides a light wash and gentle dry for delicate items such as china and crystal. For the rinse cycle, the dishwasher 100 rinses the wares for a predetermined period (e.g. 15 minutes) without detergent to reduce food odor and prevent food residue from drying. For the smart wash, the dishwasher 100 senses load size, soil amount, and toughness of soil and adjusts washing accordingly. The eco wash cycle results in a long wash cycle (e.g. 4 hours) enabling lower water and energy usage. The pots and pans cycle is designed to remove the toughest items such as casseroles with baked-on food residue. Finally, the 1-hour wash cycle is a faster wash cycle at the expense of more water and energy usage.

In one embodiment, the graphical user interface 600 rotates the carrousel 610 about the axis 612 such that the icon 620 for the selected wash cycle is positioned at a front and center position. For example, the Normal Wash icon 621 is shown in the front and center position of the carrousel 610 in FIG. 6 to depict that the Normal Wash cycle is the currently selected wash cycle. Similarly, the China Wash icon 622 is shown in the front and center position of the carrousel 610 in FIG. 7 to depict that the China Wash Cycle is the currently selected wash cycle.

In one embodiment, a user may touch the carrousel icon 620 for the desired wash cycle to cause the controller 180 to generate one or more display signals that result in the graphical user interface 600 animating the rotation of the carrousel 610 about the axis 612 until the touched carrousel icon 620 is in the front and center position of the carrousel 600. In one embodiment, the controller 180 causes the carrousel 600 to rotate in a fixed direction (e.g. clockwise) to bring the selected carrousel icon 620 to the front and center position. In another embodiment, the controller 180 determines whether a clockwise rotation or a counter-clockwise rotation is shorter and rotates the carrousel 620 in the shorter direction in order to bring the selected carrousel icon 620 to the front and center position.

In another embodiment, the graphical user interface 600 is effectively divided vertically into thirds as shown by reference lines 670, 672. In such an embodiment, the controller 180 may determine that the touchscreen panel 142 was touched toward a left side of the carrousel 610 if the user touched to the left of the left reference line 670. Similarly, the controller 180 may determine that the touchscreen panel 142 was touched toward a right side of the carrousel 610 if the user touched to the right of the right reference line 670. In response to determining that the carrousel 610 was touched toward the left side, the controller 180 may generate one or more display signals that cause the graphical user interface 600 to animate the rotation of the carrousel 610 one icon in the counter-clockwise direction 674. Likewise, in response to determining that the carrousel 610 was touched toward the right side, the controller 180 may generate one or more display signals that cause the graphical user interface 600 to animate the rotation of the carrousel 610 one icon in the clockwise direction 676. In such an embodiment, the controller 180 may determine that the selected wash cycle is the wash cycle corresponding to the wash icon 620 in the front and center position at the time the start button 640 is touched. In another embodiment, the controller 180 may require a user to touch a center portion of the display surface 145 lying between the reference lines 670, 672 before determining that the wash cycle corresponding to the front and center wash icon 620 is the selected wash cycle.

In yet another embodiment, the control panel 140 may include one or more buttons, knobs, switches, etc. associated with a display panel that displays the carrousel 610. A user may actuate the one or more buttons, knobs, switches, etc. to rotate icons 620 of the carrousel about the axis 612. The user may also actuate the one or more buttons, knobs, switches, etc. of the control panel 140 to select a wash cycle via an icon 620 of the carrousel 610 and select associated options for wash cycle.

As shown, the graphical user interface 600 further provides icons 630 via which a user may activate or de-activate wash options for the selected wash cycle. In particular, the option icons 630 may include an Zonal Spray icon 631 associated with a zonal spray option, a High Temp icon 632 associated with a high temperature option, a Steam Sanitize icon 634 associated with a sanitizing option, and a Smart Dry icon 635 associated with a drying option. The zonal spray option results in the dishwasher 100 using the high pressure sprayers 178 to provide increased cleaning of surface in the zone 179 of the washing chamber 112. The high temperature option results in the dishwasher 100 using the heating element 172 to raise the temperature of the wash liquor to improve cleaning. The sanitizing options results in the dishwasher 100 using the steam generator 170 to sanitize the wares in the dishwasher racks 120. The drying options results in the dishwasher 100 turning the heating element 172 on after the rinsing stage to aid in drying of the wares.

In one embodiment, not all options are available for every wash cycle. Accordingly, the controller 180 determines which options are available for the selected wash cycle and generates one or more display signals to cause the graphical user interface 600 to indicate which options are available. In one embodiment, the controller 180 generates signals which results in unavailable options simply not being displayed by the touchscreen panel 142. In another embodiment, the controller 180 generates signals which result in the unavailable options being grayed-out or ghosted. Below TABLE I identifies which options are available for each of the wash cycles of one embodiment of the dishwasher 100.

TABLE I

| | Zonal Spray | High Temp | Steam Sanitize | Smart Dry | Delay |
|---|---|---|---|---|---|
| Smart Wash | X | X | X | X | X |
| Pots and Pans | X | X | X | X | X |
| Normal | X | X | X | X | X |
| Eco | | | | X | X |
| China | | | | X | X |
| 1-Hr Wash | | | | X | X |
| Rinse | | | | | X |

As noted above in TABLE I, in one embodiment of the dishwasher 100, each of the options is available for the normal wash cycle, but only the drying option and delay option are available for the china wash cycle. Accordingly, FIG. 6 shows each of the options as being available since the normal wash cycle is selected. Conversely, FIG. 7 depicts that only the drying option and the delay option are available as the china options is the selected wash cycle of FIG. 7.

The controller 180 in one embodiment effectively treats the icons 630 as toggle buttons for available options and locked buttons for unavailable options. In particular, a user may touch an icon 630 associated with a currently de-activated available option to activate the option, and may touch an icon 630 associated with a currently activated available option to de-activate the option. Besides user activation of options, the controller 180 may further identify default activation of options for each of the wash cycles In one embodiment, the controller 180 generates one or more display signals which cause the graphical user interface 600 to indicate which available options are activated and which available options are de-activated. For example, the controller 180 may generate signals which result in the lighting of virtual LED's associated with each icon 630 for the activated available options and turning of the virtual LED's of de-activated options. In another embodiment, the controller 180 may generate signals which result in highlighting activated available options and not highlighting de-activated available options.

The control lock button 660 provides a control via which a user may activate a control lock option of the dishwasher 100. More specifically, a user may activate the control lock option to lock the control panel to avoid unintended use of the dishwasher between wash cycles. When locked, all controls of the graphical user interface 600 are disabled except for the control lock button 660. To turn on the lock, a user touches and holds the control lock button 660 for a predetermined period of time (e.g. 3 seconds). Similarly, to turn off the lock, a user touches and holds the control lock button 660 for a predetermined period of time (e.g. 3 seconds).

Furthermore, the graphical user interface 600 may provide a visual indication that the control panel 140 is locked or unlocked. For example, the graphical user interface 600 indicates that the control panel 140 is unlocked in FIG. 6 by depicting the control lock button 660 with an open padlock icon. Conversely, the graphical user interface 600 indicates that the control panel 140 is locked in FIG. 7 by depicting the control lock button 660 with a closed padlock icon.

Other embodiments of the graphical user interface 660 may use other mechanisms to indicate that the control panel 140 is locked. For example, the graphical user interface 600 may remove all disabled controls when locked thus resulting in the touchscreen panel 142 showing only the control lock button 660 when the control panel 140 is locked In another embodiment, the graphical user interface 600 may grey-out or ghost all disabled controls. In yet another embodiment, the graphical user interface 600 may display a message such as "Locked"; "Control Panel Locked"; or "Locked: Press and Hold Button To Unlock" in a front portion 148 of the touchscreen panel 142 to permit viewing the message while the door 130 is closed.

Figure 8:
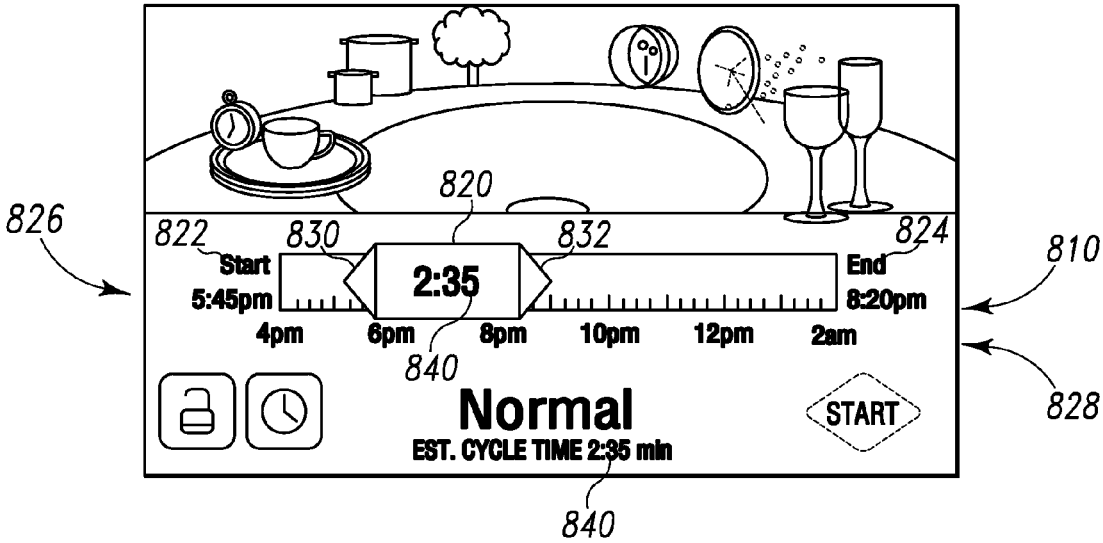
FIG. 8 shows an embodiment of a start/stop time interface of the dishwasher control panel of FIG. 6.

As noted above, the graphical user interface 600 further includes a programmed delay button 650. In one embodiment, when a user touches the programmed delay button 650, the controller 180 generates display signals which result in the graphical user interface 600 displaying the programmed delay interface 800 of FIG. 8. As shown, the programmed delay interface 800 includes a time scale 810 and a duration bar 820. The time scale 810 in one embodiment extends from a current time toward the left of the touchscreen panel 142 to future times toward the right of the touchscreen panel 142. The duration bar 820 has a length corresponding to the expected duration of the selected wash cycle given the selected options. As such, the position of the duration bar 820 on the time scale 810 defines for the wash cycle a start time 822 as a time of day and an expected stop time 824 as a time of day. In particular, the position of the left end 826 of the duration bar 820 on the time scale 810 defines the start time 822 and the position of the right end 828 on the time scale 810 defines the expected stop time 824.

In one embodiment, a user may drag the duration bar 820 to the left to stop the wash cycle earlier and may drag the duration bar 820 to the right to stop the wash cycle later. In another embodiment, the duration bar 820 includes controls 830, 832 at the ends of the duration bar 820. A user may touch the left control 830 to move the duration bar 820 to the left by a predetermined increment of time (e.g. 5 minutes) and may touch the right control 832 to move the duration bar to the right by a predetermined increment of time (e.g. 5 minutes). Thus, a user may select a desired stop time 824 for the wash cycle by moving the bar 820 along the time scale 810. For example, if the user wants the wash cycle to end near 10 pm, the user may move the bar 820 along the time scale 810 until the right end 828 aligns with 10 pm on the time scale 810. Thus, the programmed delay interface 800 permits a user to specify a specific time of day for the desired stop time 824. The controller 180 may then determine a start time 822 based upon the expected duration of the selected wash cycle and options and may start the wash cycle at the determined start time 822 when the clock 182 indicates the expected start time 822 is the current time of day.

As shown, the programmed delay interface 800 may display the estimated cycle time 840 in time units in the duration bar 820 and in the front portion 148 of the touchscreen panel 142. Further, the programmed delay interface 800 may display the start time 822 toward the left end of the time scale 810 as a time of day and the expected stop time 824 toward the right end of the time scale 810 as a time of day.

In one embodiment, the controller 180 determines the expected duration of the selected wash cycle based upon an expected duration for the selected wash cycle and the expected effects the selected options have on the duration of the wash cycle. The duration of various stages of a wash cycle are based upon sensors and as such have variable durations. While the various stages have variable durations, the various stages also have typical durations and maximum durations based upon the soil level of the wares. Essentially, the more heavily soiled the wares the longer the stage duration.

In one embodiment, the controller 180 may simply assume a worse case and use the maximum durations for heavily soiled wares. In other embodiments, the controller 180 determine the expected duration using other methods. For example, the controller 180 may determine the expected duration based upon actual durations of previous wash cycles using the same options. In other embodiments, the controller 180 may determine the expected duration based upon typical durations of the selected wash cycle and typical effects the selected options have on the selected wash cycle.

In one embodiment, the programmed delay interface 800 does not permit the user to select a desired stop time 824 if there is insufficient time to complete the wash cycle (e.g. the time remaining between the desired stop time 824 and the current time of day is less than the expected duration of the wash cycle). In the embodiment shown in FIG. 8, the programmed delay interface 800 may prevent a user from specifying a desired stop time 824 for which there is insufficient time to achieve by preventing the user from moving the duration bar 820 past the left end of the time scale 810. Other embodiments of the programmed delay interface 800, however, may not use the duration bar 820 and time scale 810 and may permit a user to simply enter a desired stop time 824. Thus, the controller 180 in some embodiments may generate display signals that result in the touchscreen panel 142 displaying a warning that the expected stop time extends beyond the desired stop time 824 if the time remaining between the desired stop time 824 and the current time of day is less than the expected duration of the selected wash cycle and selected options. In yet another embodiment, the controller 180 may suggest alternative wash cycles and/or options if the controller 180 determines there is insufficient time to achieve the desired stop time 824.

Figure 9:
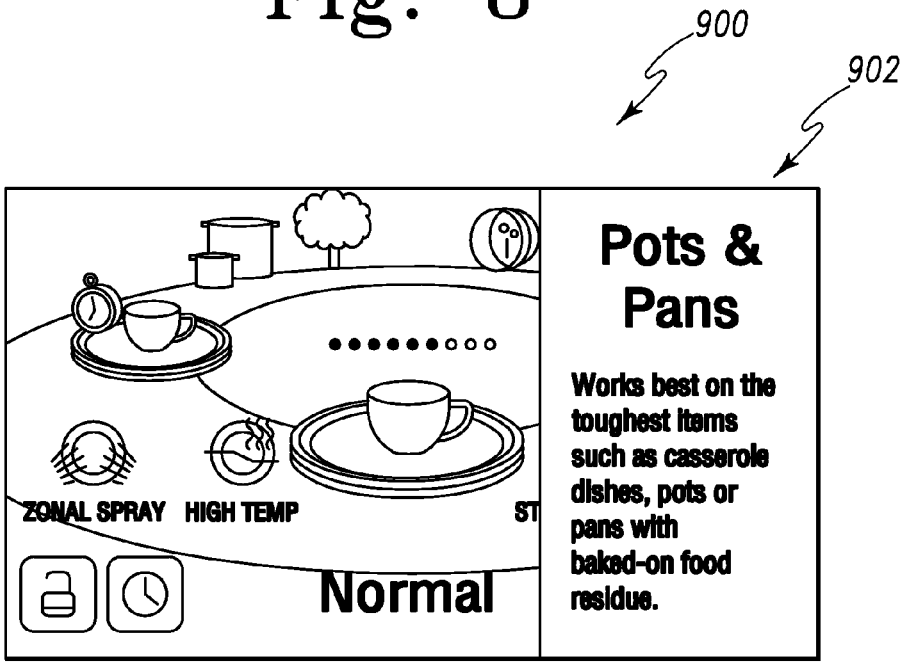
FIG. 9 shows an embodiment of a usage guidance display of the dishwasher control panel of FIG. 6.

Referring now to FIG. 9, an embodiment of a user interface 900 for showing usage guidance is depicted. In particular, the user interface 900 shows a description 902 of the Pots and Pans Wash cycle as a result of a user touching and holding the Pots and Pans Wash icon 626. In the embodiment shown, the controller 180 generates display signals that result in the description 902 sliding in from the right of the touchscreen panel 142 as an overlay in response to detecting that the touched icon 620 is toward the left of the touchscreen panel 142. Conversely, in one embodiment, the controller 180 may generate display signals that result in the description 902 sliding in from the left of the touchscreen panel 142 in response to detecting that the touched icon 620 is toward the right of the touchscreen panel 142.

The user interface 900 depicts the description as an overlay sliding in from the right side. However, it should be appreciated that the controller 180 may generate display signals that result in the user interface 900 displaying the description via other mechanisms such as, for example, displaying the description via a window having scrollbars, via a separate screen, as a marquee message scrolling across the front portion 148 of the touchscreen panel 142.

In general, the controller 180 may select usage guidance based upon user input received from the touchscreen panel 142 and may cause the touchscreen panel 142 to display the usage guidance selected based upon the user input. The controller 180 may also select usage guidance based upon detected operating status of the dishwasher and may cause the touchscreen panel 142 to display the usage guidance selected based upon the operating status of the dishwasher. Generally categories of usage guidance include loading tips that provide guidance regarding loading of the dishwasher, performance tips that suggest actions to be undertaken by a user to increase efficiency of the dishwasher, how-to guides or tutorials explaining how to accomplish certain tasks such as setting the clock 182, and calibrating the dishwasher. Usage guidance may also include wash cycle descriptions such as the one shown in FIG. 9 which provides information regarding intended use of the selected wash cycle. Usage guidance may also include option descriptions that provide information regarding an effect a selected option has an a wash cycle. Other examples of usage guidance include instructing a user that a dish may be added even though the wash cycle is still running if the controller 180 determine sufficient time remains, or instructing a user to add rinse aid if the controller 180 detects that the rinse aid is low.

The dishwasher 100 may maintain energy utilization data such as the amount of energy and/or water used during specific periods. Based upon such utilization data, the dishwasher 100 may present usage guidance that presents information regarding the historical utilization energy by the dishwasher 100. For example, the dishwasher 100 may provide various line charts, graphs, etc. that depict usage of energy and water during specific times of day, days, weeks, months, etc.

Some specific examples of loading tips include:

Load forks and spoons so they don't nest together. Mix items in each section of the silverware basket. Use basket cover to keep silverware separated.

Load heavily soiled cookware face down in the rack, facing the sprayer at the back of the dishwasher.

Load glasses in top rack only. The bottom rack is not designed for glasses and damage may occur.

When loading the bottom rack, make sure the detergent dispenser is not blocked.

Check that all spray arms can spin freely before each cycle.

Some specific examples of performance tips include:

Use rinse aid for best drying.

To save water, energy scrape dishes but do not rinse them before loading into the dishwasher.

Use only automatic dishwashing detergent. Never use hand washing detergent.

Use the recommended amount of detergent per U&C guide

Hard water can affect the performance of your dishwasher. Check for mineral build-up on spray nozzles and consider using a dishwasher cleaning product or a water softener.

Clean out filter at least once a month or more often if you notice reduced performance.

While the disclosure has been illustrated and described in detail in the drawings and foregoing description, such an illustration and description is to be considered as exemplary and not restrictive in character, it being understood that only illustrative embodiments have been shown and described and that all changes and modifications that come within the spirit of the disclosure are desired to be protected.

There are a plurality of advantages of the present disclosure arising from the various features of the apparatus, system, and method described herein. It will be noted that alternative embodiments of the apparatus, system, and method of the present disclosure may not include all of the features described yet still benefit from at least some of the advantages of such features. Those of ordinary skill in the art may readily devise their own implementations of the apparatus, system, and method that incorporate one or more of the features of the present invention and fall within the spirit and scope of the present disclosure as defined by the appended claims.

What is claimed is:

1. A dishwasher, comprising:

a tub defining a washing chamber, a dishwasher rack positioned in the washing chamber of the tub, a door to permit access to the washing chamber, a touchscreen panel to receive user input and to display usage guidance, and a controller coupled to the touchscreen panel and configured to select the usage guidance based upon the user input and cause the touchscreen panel to display the usage guidance selected based upon the user input, wherein the usage guidance based upon the user input includes at least three or more selected from the group consisting of: loading tips, performance tips, wash cycle descriptions, option descriptions, directions for performing maintenance, historical usage of energy and historical usage of water.

2. The dishwasher of claim 1, wherein the usage guidance selected based upon the user input includes loading tips that provide guidance regarding loading of the dishwasher.

3. The dishwasher of claim 1, wherein the usage guidance selected based upon the user input includes performance tips that suggest actions to be undertaken by a user to increase efficiency of the dishwasher.

4. The dishwasher of claim 1, wherein the usage guidance selected based upon the user input includes wash cycle descriptions that provide information regarding intended use of a selected wash cycle.

5. The dishwasher of claim 1, wherein the usage guidance selected based upon the user input includes option descriptions that provide information regarding an effect a selected option has on a wash cycle.

6. The dishwasher of claim 1, wherein the usage guidance selected based upon the user input includes directions for performing maintenance on the dishwasher.

7. The dishwasher of claim 1, wherein the controller further selects usage guidance based upon operating status of the dishwasher and causes the touchscreen panel to display the usage guidance selected based upon the operating status.

8. The dishwasher of claim 7, wherein the usage guidance based upon operating status of the dishwasher includes instructing a user that a dish may be added even though the wash cycle is running if sufficient time remains in the wash cycle.

9. The dishwasher of claim 7, wherein the usage guidance based upon operating status of the dishwasher includes directing a user to add rinse aid in response to detecting that the rinse aid is low.

10. A dishwasher, comprising:

a tub defining a washing chamber, a dishwasher rack positioned in the washing chamber of the tub, a door to permit access to the washing chamber, a touchscreen panel to receive user input and to display usage guidance, and a controller coupled to the touchscreen panel and configured to control operation of the dishwasher based upon the user input, to select the usage guidance based upon operating status of the dishwasher, and to cause the touchscreen panel to display the usage guidance selected based upon the operating status of the dishwasher, wherein the usage guidance based upon operating status includes instructions that a dish may be added during a wash cycle and directing a user to add rinse aid in response to detecting that the rinse aid is low.

11. The dishwasher of claim 10, wherein the usage guidance based upon operating status of the dishwasher includes instructing a user that a dish may be added even though the wash cycle is running if sufficient time remains in the wash cycle.

12. The dishwasher of claim 10, wherein the controller further selects usage guidance based upon the user input and causes the touchscreen panel to display the usage guidance selected based upon the user input.

13. The dishwasher of claim 12, wherein the usage guidance selected based upon the user input is selected from the group consisting of: loading tips, performance tips, wash cycle descriptions, option descriptions, directions for performing maintenance, historical usage of energy and historical usage of water.

14. The dishwasher of claim 10, wherein the door of the dishwasher includes a front surface portion and a top surface portion, said touchscreen panel being provided on the top surface portion of the door.

15. A method for controlling a dishwasher including a tub defining a washing chamber, a dishwasher rack positioned in the washing chamber of the tub, a door to permit access to the washing chamber, a touchscreen panel to receive user input and to display usage guidance, and a controller coupled to the touchscreen panel to select the usage guidance based upon one of user input and operating status of the dishwasher, the method comprising:

when the usage guidance is based upon user input, the usage guidance includes at least three or more selected from the group consisting of: loading tips, performance tips, wash cycle descriptions, option descriptions, directions for performing maintenance, historical usage of energy and historical usage of water;

when the usage guidance is based on operating status, the usage guidance includes instructions that a dish may be added during a wash cycle and directing a user to add rinse aid in response to detecting that the rinse aid is low; and displaying the usage guidance on the touchscreen panel.

* * * * *